US011406244B2

(12) United States Patent
Ko

(10) Patent No.: US 11,406,244 B2
(45) Date of Patent: Aug. 9, 2022

(54) RACK FOR DISHWASHER AND DISHWASHER HAVING THE SAME

(71) Applicant: LG Electronics Inc., Seoul (KR)

(72) Inventor: Myungwon Ko, Seoul (KR)

(73) Assignee: LG Electronics Inc., Seoul (KR)

( * ) Notice: Subject to any disclaimer, the term of this patent is extended or adjusted under 35 U.S.C. 154(b) by 85 days.

(21) Appl. No.: 16/919,417

(22) Filed: Jul. 2, 2020

(65) Prior Publication Data

US 2021/0000325 A1 Jan. 7, 2021

(30) Foreign Application Priority Data

Jul. 3, 2019 (KR) ..... 10-2019-0080047

(51) Int. Cl.
*A47L 15/42* (2006.01)
*A47L 15/50* (2006.01)

(52) U.S. Cl.
CPC ..... *A47L 15/50* (2013.01); *A47L 15/4278* (2013.01); *A47L 15/502* (2013.01); *A47L 15/504* (2013.01)

(58) Field of Classification Search
None
See application file for complete search history.

(56) References Cited

U.S. PATENT DOCUMENTS

| | | | |
|---|---|---|---|
| 4,157,145 | A | 6/1979 | Jordan |
| 4,192,432 | A | 3/1980 | Jordan |
| 5,086,544 | A | 2/1992 | Huttemann et al. |
| 5,881,906 | A | 3/1999 | Rogers et al. |
| 2018/0206700 | A1 | 7/2018 | Ko et al. |

FOREIGN PATENT DOCUMENTS

| | | |
|---|---|---|
| CN | 201005658 | 1/2008 |
| DE | 3721689 | 1/1989 |
| EP | 1707101 | 10/2006 |
| EP | 2220989 | 8/2010 |
| KR | 1020170021641 | 2/2017 |

OTHER PUBLICATIONS

Office Action in Australian Appln. No. 2020204432, dated Aug. 3, 2021, 4 pages.
Extended European Search Report in European Application No. 20183643.4, dated Dec. 18, 2020, 8 pages.
Korean Office Action in Korean Application No. 10-2019-0080047, dated Dec. 11, 2020, 20 pages (with English translation).

*Primary Examiner* — Levon J Shahinian
(74) *Attorney, Agent, or Firm* — Fish & Richardson P.C.

(57) ABSTRACT

A rack of a dishwasher includes a loading space that accommodates one or more objects to be washed and has a loading surface, an outer edge rib disposed around the loading surface, lower ribs that extend in a first direction from a side of the outer edge rib, and upper ribs that are disposed vertically above the lower ribs and extend in a second direction crossing the first direction.

19 Claims, 10 Drawing Sheets

RACK FOR DISHWASHER AND DISHWASHER HAVING THE SAME

CROSS-REFERENCE TO RELATED APPLICATIONS

This application claims the benefit of the Korean Patent Application No. 10-2019-0080047, filed on Jul. 3, 2019, which is hereby incorporated by reference as if fully set forth herein.

TECHNICAL FIELD

The present disclosure relates to a dishwasher, and more particularly, to a rack and a dishwasher having the same to improve drainage performance.

BACKGROUND

A dishwasher may spray high-pressure wash water to dishes received therein to wash the dishes and dry the washed dishes. For example, the dishwasher may spray high-pressure wash water into a tub, in which dishes are received, and the sprayed wash water may remove foreign matter, such as food waste, from the surfaces of the dishes.

In some cases, the dishwasher may include a filter configured to filter food waste contained in wash water for reuse of the used wash water, and may supply wash water containing detergent to smoothly separate food waste from dishes. In some examples, the dishwasher may increase the temperature of wash water or generate steam using a heater to improve washing efficiency.

A dishwasher may include a case defining the external appearance thereof, a washing tub provided in the case for defining a washing space in which dishes are washed, a door disposed in front of the washing tub for opening and closing the washing tub, a drive unit provided under the washing tub for supplying, collecting, circulating, and draining wash water, lower, upper, and top spraying units for spraying wash water supplied by the drive unit to the dishes, and lower, upper, and top racks separably provided between the lower, upper, and top spraying units, the lower, upper, and top racks being selectively loaded in the washing tub based on the kind or size of the dishes.

Each rack may include, at the lower part thereof, a plurality of moving rollers, which are guided along guide rails provided at the inside of the washing tub such that the rack is introduced into or withdrawn from the washing tub.

The lower rack may be disposed adjacent to the lower spraying unit to receive relatively large-sized dishes. The upper rack may be disposed adjacent to the upper spraying unit to receive relatively small-sized dishes. The top rack may be disposed adjacent to the top spraying unit to receive eating utensils such as silverware (e.g. spoons and knives) and cooking utensils (e.g. dippers and whisks) having smaller sizes than dishes.

A user may open a door of the dishwasher, withdraw one of the racks from the washing tub, place dishes in the withdrawn rack, push the withdrawn rack back into the washing tub of the dishwasher, and close the door.

The user may operate the dishwasher to supply wash water individually or simultaneously to the lower, upper, and top spraying units according to the operation of the drive unit in order to wash the dishes loaded in the lower, upper, and top racks.

In some cases, the top rack may accommodate and wash relatively small-sized dishes (e.g., utensils), and may have a narrow lattice type base to restrict the utensils from being withdrawn therefrom.

In some cases, wash water remaining in the lattice type base of the top rack may drop to upper/lower racks arranged at a lower portion, and may wet the dried utensils in the upper/lower racks.

Therefore, it is of interest to design a rack that may actively drain the wash water remaining in the rack.

SUMMARY

The present disclosure describes a rack for a dishwasher and a dishwasher having the same.

For example, the present disclosure describes a rack for a dishwasher and a dishwasher having the same, which may improve drying efficiency of eating utensils by improving drainage performance of the rack for the dishwasher.

In some implementations, the rack and the dishwasher may minimize wash water remaining in the rack by improving a structure of the rack.

In some implementations, the rack and the dishwasher may minimize wash water remaining between eating utensils and the rack by minimizing a contact area between the eating utensils loaded in the rack and the rack through improvement of a structure of the rack.

In some implementations, the rack and the dishwasher may minimize wash water remaining in an intersection point of a plurality of ribs, which cross one another to form a loading space in a loading portion of the dishwasher, by varying an intersection height of the ribs.

In some implementations, the rack and the dishwasher may more actively flow washing water remaining in a plurality of ribs, which cross one another to form a loading space in a loading portion of the dishwasher, by improving a shape of the ribs.

According to one aspect of the subject matter described in this application, a rack of a dishwasher includes a loading space that is configured to accommodate one or more objects to be washed and has a loading surface, an outer edge rib disposed around the loading surface, a plurality of lower ribs that extend in a first direction from a side of the outer edge rib, and a plurality of upper ribs that are disposed vertically above the plurality of lower ribs and extend in a second direction crossing the first direction.

Implementations according to this aspect may include one or more of the following features. For example, a lower rib among the plurality of lower ribs may include an upper inclined portion disposed at an upper portion of the lower rib, where the upper inclined portion defines upper inclined surfaces that extend downward and are inclined with respect to a center line of the lower rib. In some examples, the lower rib may further include a lower curvature portion disposed vertically below the upper inclined portion, where the lower curvature portion defines lower curved surfaces that are curved toward the center line of the lower rib.

In some examples, a height of the lower curvature portion with respect to a lower end of the lower curvature portion may be greater than a height of the upper inclined portion with respect to an upper end of the lower curvature portion. In some examples, an upper rib among the plurality of upper ribs may include an upper curvature portion arranged across the upper inclined portion of the lower rib, where the upper curvature portion defines upper curved surfaces that extend toward the loading surface.

In some examples, the upper rib may further include a lower inclined portion that is disposed vertically below the upper curvature portion and crosses at least a portion of the lower curvature portion of the lower rib, where the lower inclined portion defines lower inclined surfaces that extend toward a center line of the upper rib. In some examples, a height of the upper curvature portion with respect to an upper end of the lower inclined portion may be greater than a height of the lower inclined portion with respect to a lower end of the lower inclined portion.

In some implementations, the upper rib may cross the lower rib, the upper rib may define a first boundary line between the upper curvature portion and the lower inclined portion of the upper rib, and the lower rib may define a second boundary line between the upper inclined portion and the lower curvature portion of the lower rib. The first boundary line and the second boundary line may be disposed at a same height with respect to a lower end of the lower curvature portion.

In some implementations, a rack of the dishwasher may further include a rib connector that has a curved shape and connects the outer edge rib to a lower rib among the plurality of lower ribs or to an upper rib among the plurality of upper ribs, where the rib connector may be positioned vertically between the lower rib and the upper rib with respect to the loading surface. In some examples, the rib connector may include an upper curvature section that has a curved shape and is disposed at the upper rib or the lower rib. In some examples, the rib connector may further include a lower curvature section that has a curved shape and is disposed vertically below the upper rib or the lower rib.

In some implementations, the rack of the dishwasher may further include a guide rib that is disposed vertically above the plurality of lower ribs and extends across the plurality of lower ribs in the second direction, where the guide rib is positioned vertically above the at least one of the plurality of upper ribs. In some implementations, the rack of the dishwasher may include a support rib that is disposed vertically above the plurality of lower ribs and extends across the plurality of lower ribs in the second direction, where the support rib defines a plurality of grooves arranged along the second direction.

In some implementations, the rack of the dishwasher may include a partition rib that is disposed vertically above the plurality of lower ribs and extends across the plurality of lower ribs in the second direction. The partition rib may include a plurality of partition protrusions arranged along the second direction and spaced apart from one another by a predetermined interval.

In some implementations, a lower rib among the plurality of lower ribs may include: a first upper inclined portion that is disposed at an upper portion of the lower rib and defines first upper inclined surfaces that extend downward and are inclined with respect to a center line of the lower rib, and a first lower inclined portion that is arranged vertically below the first upper inclined portion and defines first lower inclined surfaces that extend toward the center line of the lower rib. An upper rib among the plurality of upper ribs may include a second upper inclined portion that is disposed at an upper portion of the upper rib and defines second upper inclined surfaces that extend downward and are inclined with respect to a center line of the upper rib, and a second lower inclined portion that is arranged vertically below the second upper inclined portion and defines second lower inclined surfaces that extend toward the center line of the upper rib.

In some implementations, a lower rib among the plurality of lower ribs may include a first upper curvature portion that is disposed at an upper portion of the lower rib and defines first upper curved surfaces that are curved and extend toward the loading surface, and a first lower curvature portion that is arranged vertically below the first upper curvature portion and defines first lower curved surfaces that are curved and extend toward a center line of the lower rib. An upper rib among the plurality of upper ribs may include a second upper curvature portion that is disposed at an upper portion of the upper rib and defines second upper curved surfaces that are curved and extend toward the loading surface, and a second lower curvature portion that is arranged vertically below the second upper curvature portion and defines second lower curved surfaces that are curved and extend toward a center line of the upper rib.

According to another aspect, a dishwasher includes a washing tub that defines a washing space, a rack that is configured to accommodate one or more objects to be washed and to be inserted into and withdrawn out of the washing tub, and a plurality of sprayer configured to spray wash water to the rack. The rack includes a loading space that is configured to accommodate the one or more objects and has a loading surface, an outer edge rib disposed around the loading surface, a plurality of lower ribs that extend in a first direction from a side of the outer edge rib, and a plurality of upper ribs that are disposed vertically above the plurality of lower ribs and extend in a second direction crossing the first direction.

Implementations according to this aspect may include one or more of the following features or the features described above for the rack. For example, a lower rib among the plurality of lower ribs may include an upper inclined portion that is disposed at an upper portion of the lower rib and defines upper inclined surfaces that extend downward and are inclined with respect to a center line of the lower rib, and a lower curvature portion that is disposed vertically below the upper inclined portion and defines lower curved surfaces that are curved toward the center of the lower rib.

In some implementations, an upper rib among the plurality of upper ribs may include an upper curvature portion that is arranged across the upper inclined portion of the lower rib and defines upper curved surfaces that extend toward the loading surface, and a lower inclined portion that is disposed vertically below the upper curvature portion and crosses at least a portion of the lower curvature portion. The lower inclined portion may define lower inclined surfaces that extend toward a center of the upper rib.

In some examples, the upper rib may cross the lower rib, the upper rib may define a first boundary line between the upper curvature portion and the lower inclined portion of the upper rib, and the lower rib may define a second boundary line between the upper inclined portion and the lower curvature portion of the lower rib. The first boundary line and the second boundary line may be disposed at a same height with respect to a lower end of the lower curvature portion.

In some implementations, when eating utensils are loaded for washing in the dishwasher, a loading space for the eating utensils may efficiently be used in accordance with shapes and sizes of the eating utensils loaded in the rack.

In some implementations, it may be possible to improve drying efficiency of the eating utensils by improving drainage performance of the rack for the dishwasher.

In some implementations, it may be possible to minimize wash water remaining in the rack by improving a structure of the rack.

In some implementations, it may be possible to minimize wash water remaining between eating utensils and the rack by minimizing a contact area between the eating utensils loaded in the rack and the rack through improvement of a structure of the rack.

It is to be understood that both the foregoing general description and the following detailed description of the present disclosure are exemplary and explanatory and are intended to provide further explanation of the disclosure as claimed.

DETAILED DESCRIPTION

Reference will now be made in detail to one or more examples of the present disclosure, examples of which are illustrated in the accompanying drawings.

Hereinafter, one or more implementations of a dishwasher according to of the present disclosure will be described in detail with reference to the accompanying drawings.

Figure 1:
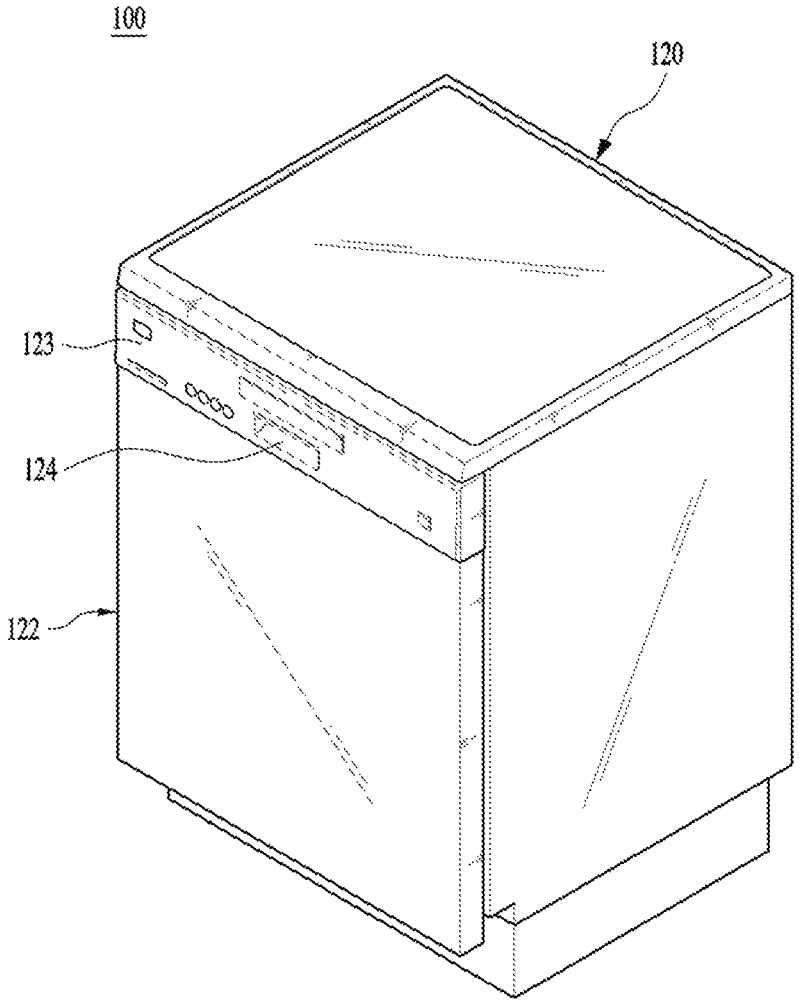
FIG. 1 is a perspective view illustrating an example of a dishwasher.
Figure 2:
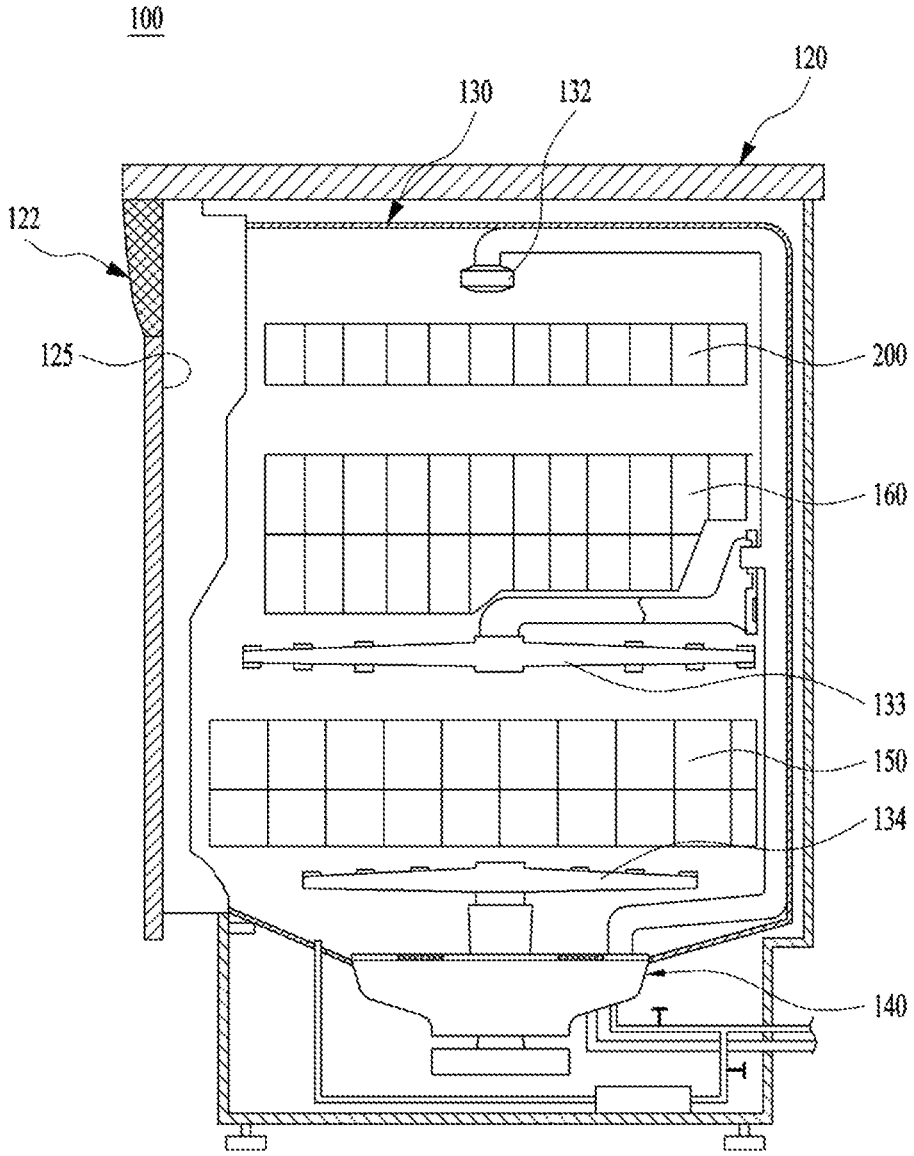
FIG. 2 is a schematic view illustrating an example of an inner structure of the dishwasher.

FIG. 1 is a perspective view showing an example of a dishwasher, and FIG. 2 is a view showing an example of an internal structure of the dishwasher.

In some implementations, as shown in FIGS. 1 and 2, a dishwasher 100 may include a case 120 defining the external appearance thereof, a washing tub 130 mounted in the case 120 for defining a washing space, in which dishes are washed, the washing tub 130 having a front open surface, a door 122 for opening and closing the open surface of the washing tub 130, a drive unit 140 provided under the washing tub 130 for supplying, collecting, circulating, and draining wash water, a plurality of racks 150, 160, and 200 separably provided in the washing tub 130 for receiving dishes, and a plurality of sprayer or spraying units 132, 133, and 134 respectively provided adjacent to the racks 150, 160, and 200 for spraying wash water to wash one or more object such as dishes.

The racks 150, 160, and 200 may be disposed in the washing tub 130 and configured to be withdrawn from the washing tub 130 through the open surface of the washing tub 130. The racks may include a first rack 150 provided in the lower part of the washing tub 130 for receiving relatively large-sized dishes, a second rack 160 provided above the first rack 150 for receiving relatively small-sized dishes, and a third rack 200 provided in the upper part of the washing tub 130 for receiving cutlery and the like. In some examples, the first rack 150 may be a lower rack, the second rack 160 may be a middle rack, and the third rack 200 may be an upper or top rack.

The spraying units 132, 133, and 134 are provided to spray wash water to the dishes received in the racks 150, 160, and 200, respectively. The spraying units include a lower spraying unit 134 provided in the lower part of the washing tub 130 for spraying wash water to the first rack 150, an upper spraying unit 133 provided between the first rack 150 and the second rack 160 for spraying wash water to the first and second racks 150 and 160, and a top spraying unit 132 provided in the upper part of the washing tub 130 for spraying wash water to the third rack 200 or the second rack 160. In some examples, each of the spraying units 132, 133, and 134 may include a spray nozzle configured to discharge wash water toward the racks.

In some examples, the washing tub 130 may include guide rails for guiding the withdrawal and introduction of the first, second, and third racks 150, 160, and 200, and the guide rails may be provided at opposite sidewalls of the washing tub 130. The guide rails may include fixed guide rails for guiding the withdrawal and introduction of the first rack 150 and telescopic guide rails for guiding the withdrawal and introduction of the second and third racks 160 and 200, the length of the telescopic guide rails being increased as the second and third racks 160 and 200 are withdrawn.

The door 122 may be configured to open and close the front open surface of the washing tub 130. The door 122 is provided at the lower end of the open surface thereof with a hinge unit, about which the door 122 is hingedly rotated such that the door 122 is opened and closed.

The door 122 is provided at the outer surface thereof with a grip 124 for opening the door 122 and a control panel 123 for controlling the dishwasher 100. When the door 122 is closed, the inner surface of the door 122 defines one surface of the washing tub 130.

When the door 122 is opened, the inner surface of the door 122 defines a location surface on which the first rack 150 is located. To this end, when the door 122 is opened, the location surface of the door 122 may horizontally extend from the guide rails for guiding the first rack 150.

Specifically, the present disclosure describes the third rack 200 and the dishwasher 100 having the same.

Hereinafter, the third rack 200 will be described in detail with reference to the accompanying drawings.

Figure 3:
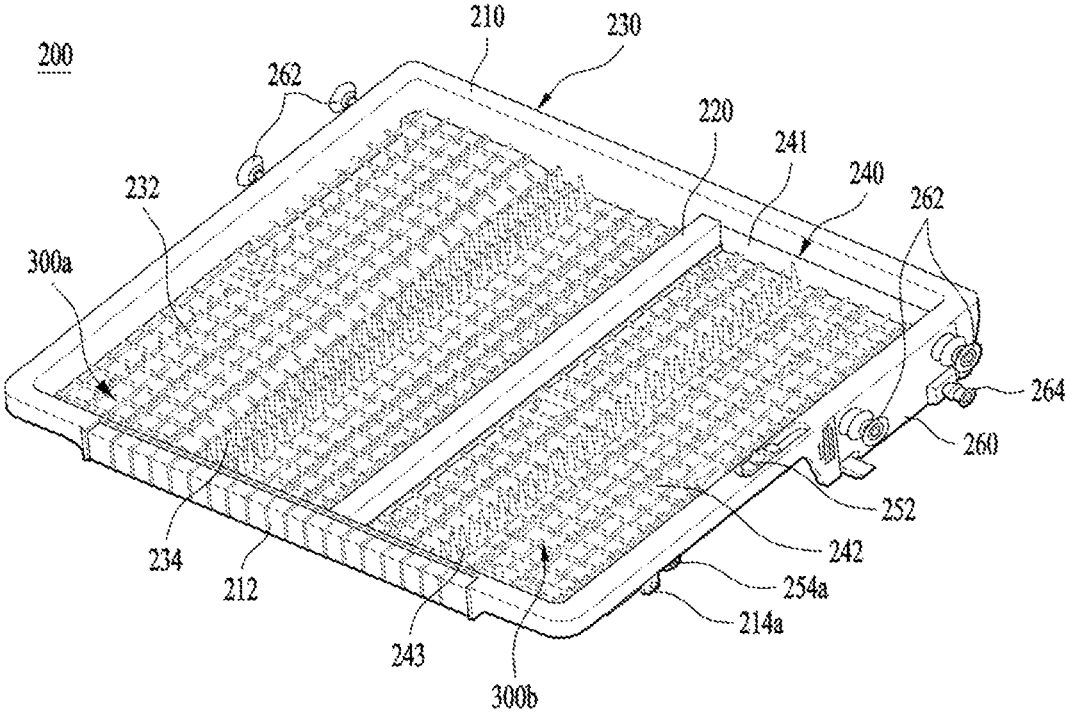
FIG. 3 is a perspective view illustrating an example of a first use state of an example rack in the dishwasher.
Figure 4:
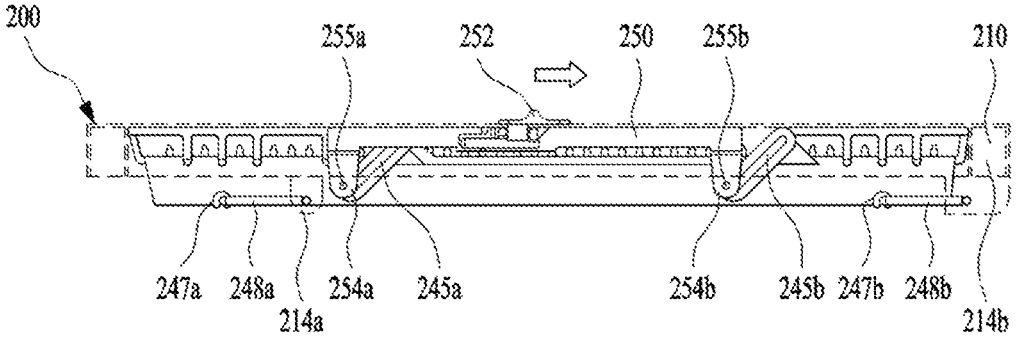
FIG. 4 is a side view illustrating an example of the first use state of the rack in the dishwasher.

FIG. 3 is a perspective view showing an example of a first use state of a third rack of the dishwasher, and FIG. 4 is a side view showing the first use state of the third rack of the dishwasher.

As shown in FIGS. 3 and 4, the third rack 200 includes a fixed space loading unit 230 defining a fixed loading space and a variable space loading unit 240 defining a variable loading space. For instance, the fixed space loading unit 230 may include ribs, plates, walls, or the like to define the fixed loading space. The variable space loading unit 240 may include ribs, plates, walls, or the like and be configured to move relative to the fixed spacing loading unit.

General-sized dishes may be loaded into the fixed space loading unit 230. Dishes having sizes that make them difficult to load into the fixed space loading unit 230 or dishes that waste the loading space in the first or second rack 150 or 160 when loaded in the first or second rack 150 or 160 may be selectively loaded into the variable space loading unit 240.

The third rack 200 further includes an outer edge rib 210 defining the outer edge of the fixed space loading unit 230 or the variable space loading unit 240, a middle partition rib 220 for partitioning the interior of the third rack 200 into the fixed space loading unit 230 and the variable space loading unit 240, a lifting unit 250 for upwardly and downwardly moving the variable space loading unit 240 to vary the loading space of the variable space loading unit 240, and moving roller units 260 supported by the telescopic guide rails such that the third rack 200 is withdrawn from the washing tub 130.

The outer edge rib 210 defines the outer edge of the third rack 200. The outer edge rib 210 is configured to correspond to the inner size of the washing tub 130. The outer edge rib 210 is formed to have a hollow box shape in order to improve the strength of the third rack 200. A grip 212 for introducing and withdrawing the third rack 200 is formed at the front of the outer edge rib 210.

In addition, the outer edge rib 210 is provided at the lower part of one side thereof with a first front link turning unit 214*a* and a first rear link turning unit 214*b*, to which a front support link 248*a* and a rear support link 248*b*, a description of which will follow, are rotatably coupled. The first front link turning unit 214*a* and the first rear link turning unit 214*b* will be described in detail when describing the variable space loading unit 240.

The moving roller units 260, supported by the telescopic guide rails provided at the washing tub 130, are provided at the rears of opposite sides of the outer edge rib 210. The moving roller units 260 include upper moving rollers 262 for supporting the upper surfaces of the telescopic guide rails and lower moving rollers 264 for supporting the lower surfaces of the telescopic guide rails.

The middle partition rib 220 partitions the interior of the third rack 200, defined by the outer edge rib 210, into the fixed space loading unit 230 and the variable space loading unit 240.

The middle partition rib 220 may partition the interior of the third rack 200, defined by the outer edge rib 210, into the fixed space loading unit 230 and the variable space loading unit 240 in the direction in which the third rack 200 is withdrawn or in the direction perpendicular to the direction in which the third rack 200 is withdrawn. In this embodiment, the middle partition rib 220 partitions the interior of the third rack 200, defined by the outer edge rib 210, into the fixed space loading unit 230 and the variable space loading unit 240 in the direction in which the third rack 200 is withdrawn.

The middle partition rib 220 is provided at the lower part thereof with a second front link turning unit 222*a* and a second rear link turning unit 222*b*, which are opposite the first front link turning unit 214*a* and the first rear link turning unit 214*b*, respectively.

The variable space loading unit 240 is upwardly and downwardly movably supported by a front support link 248*a* rotatably provided between the first front link turning unit 214*a* and the second front link turning unit 222*a* and a rear support link 248*b* rotatably provided between the first rear link turning unit 214*b* and the second rear link turning unit 222*b*.

The fixed space loading unit 230 may be formed at the other side (or one side) of the space partitioned by the middle partition rib 220. The fixed space loading unit 230 is provided with a fixed loading surface 300*a* formed on a lower surface between the outer edge rib 210 and the middle partition rib 220 to arrange eating utensils thereon.

The variable space loading unit 240 is provided to ascend by being spaced apart from the outer edge rib 210 and the middle partition rib 220 at one side (or the other side) of the space partitioned by the middle partition rib 220.

The variable space loading unit 240 may include a variable loading surface 300*b* forming a surface where eating utensils are loaded, a guide rib 241 protruded from an outer side of the variable loading surface 300*b* to form a space where eating utensils are loaded, and front support link 248*a* and rear support link 248*b* rotatably coupled to the first front link turning unit 214*a* and the first rear link turning unit 214*b* and the second front link turning unit 222*a* and the second rear link turning unit 222*b* of the outer edge rib 210 to support the lower portion of the variable loading surface 300*b*.

The fixed loading surface 300*a* of the fixed space loading unit 230 and the variable loading surface 300*b* of the variable space loading unit 240 may be formed by intersection between a plurality of lower ribs 310 and a plurality of upper ribs 320, and will be described in detail with reference to separate drawings below.

In some implementations, a front link insertion slot 247*a* and a rear link insertion slot 247*b* for insertion into the front support link 248*a* and the rear support link 248*b* may be formed on the lower surface of the variable loading surface 300*b*, and the variable space loading unit 240 is supported by the front support link 248*a* and the rear support link 248*b* to enable pendulum movement.

That is, if the front support link 248*a* and the rear support link 248*b* are close to a horizontal portion, the position of the variable loading surface 300*b* ascends, and if the front support link 248*a* and the rear support link 248*b* are close to a vertical portion, the position of the variable loading surface 300*b* descends, whereby the loading space of the variable space loading unit 240 may be varied.

The guide rib 241 of the variable space loading unit 240 is provided at one side thereof with a front inclined slot 245*a* and a rear inclined slot 245*b* having a predetermined angle of inclination. The front inclined slot 245*a* and the rear inclined slot 245*b* are arranged parallel to each other. The front inclined slot 245*a* and the rear inclined slot 245*b* are coupled to the lifting unit 250, a description of which will follow, such that the front inclined slot 245*a* and the rear inclined slot 245*b* slide along with the movement of the lifting unit 250 to upwardly and downwardly move the variable space loading unit 240.

The front inclined slot 245*a* and the rear inclined slot 245*b* are respectively provided at the lower ends thereof with a front holding hole 246*a* and a rear holding hole 246*b*, through which the guide rib 241 is held by the lifting unit 250. The front inclined slot 245*a*, the rear inclined slot 245*b*, the front holding hole 246*a*, and the rear holding hole 246*b* will be described in detail when describing the lifting unit 250.

The lifting unit 250 upwardly or downwardly moves the variable space loading unit 240 of the third rack 200 relative to the outer edge rib 210 and the middle partition rib 220 in order to decrease or increase the loading space (specifically the loading depth) of the variable space loading unit 240.

The lifting unit 250 includes a lifting lever 252 for moving the lifting unit 250, a front extension 254*a* extending from the lifting lever 252 to the front inclined slot 245*a* of the variable space loading unit 240, a rear extension 254*b* extending from the lifting lever 252 to the rear inclined slot 245*b* of the variable space loading unit 240, a front slide protrusion 255*a* protruding from the front extension 254*a* so as to be inserted into the front inclined slot 245*a* and then slide, and a rear slide protrusion 255*b* protruding from the rear extension 254*b* so as to be inserted into the rear inclined slot 245*b* and then slide.

The lifting lever 252, the front and rear extensions 254*a* and 254*b*, and the front and rear slide protrusions 255*a* and 255*b* may be integrally formed by injection molding. Alternatively, the lifting lever 252, the front and rear extensions 254*a* and 254*b*, and the front and rear slide protrusions 255*a* and 255*b* may be separately formed so as to be separated from each other as needed.

The lifting unit 250 is disposed in the inner space of the outer edge rib 210, which is formed to increase the strength of the third rack 200. The lifting lever 252 is provided so as to extend through the outer edge rib 210 and to protrude above the outer edge rib 210.

The front extension 254*a* extends from the inner space of the outer edge rib 210 to the front inclined slot 245*a*. The front slide protrusion 255*a*, which is inserted into the front inclined slot 245*a*, is provided at one end of the front extension 254*a*.

The rear extension 254*b* extends from the inner space of the outer edge rib 210 to the rear inclined slot 245*b*. The rear slide protrusion 255*b*, which is inserted into the rear inclined slot 245*b*, is provided at one end of the rear extension 254*b*.

The front inclined slot 245*a* and the rear inclined slot 245*b*, which are formed at the variable space loading unit 240, are inclined upward in the direction in which the lifting unit 250 is moved. The front holding hole 246*a* and the rear holding hole 246*b*, in which the front slide protrusion 255*a* and the rear slide protrusion 255*b* are respectively held, are respectively provided at the lower ends of the front inclined slot 245*a* and the rear inclined slot 245*b*.

When the lifting unit 250 is moved to the front side of the third rack 200, therefore, the front slide protrusion 255*a* and the rear slide protrusion 255*b* of the lifting unit 250 are respectively held in the front holding hole 246*a* and the rear holding hole 246*b* of the variable space loading unit 240 to support the variable space loading unit 240 in the state in which the variable space loading unit 240 is raised.

When the lifting unit 250 is moved to the rear side of the third rack 200, the front slide protrusion 255*a* and the rear slide protrusion 255*b* are respectively separated from the front holding hole 246*a* and the rear holding hole 246*b* and then respectively move along the front inclined slot 245*a* and the rear inclined slot 245*b*. As a result, the front inclined slot 245*a* and the rear inclined slot 245*b* are pushed. In some examples, the variable space loading unit 240 may move downward relative to the lifting unit 250, the outer edge rib 210, and the middle partition rib 220, whereby the loading depth of the variable space loading unit 240 may be increased. That is, the loading space of the variable space loading unit 240 is increased.

The outer edge rib 210, the middle partition rib 220, and fixed space loading unit 230 may be integrally formed by injection molding. The middle partition rib 220 and the fixed space loading unit 230 may be omitted as needed. That is, the entirety of the inner space of the outer edge rib 210, which defines the third rack 200, may constitute the variable space loading unit 240.

Hereinafter, the fixed loading surface 300*a* formed in the fixed space loading unit 230 and the variable loading surface 300*b* formed in the variable space loading unit 240 will be described in detail with the accompanying drawings.

In some implementations, the fixed loading surface 300*a* and the variable loading surface 300*b* may be formed by the plurality of ribs 310 and 320 that cross each other, and a plurality of communication hole 270 for draining wash water may be formed between the respective ribs 310 and 320.

In some implementations, the fixed loading surface 300*a* and the variable loading surface 300*b* may be formed to be very similar to each other. In the following description, a description will be given based on the fixed loading surface 300*a* formed in the fixed space loading unit 230. However, the variable loading surface 300*b* of the variable space loading unit 240 is not limited to a specific shape. If the variable loading surface 300*b* includes an element for forming the fixed loading surface 300*a*, it may be considered that it pertains to the scope of the present disclosure.

Figure 5:
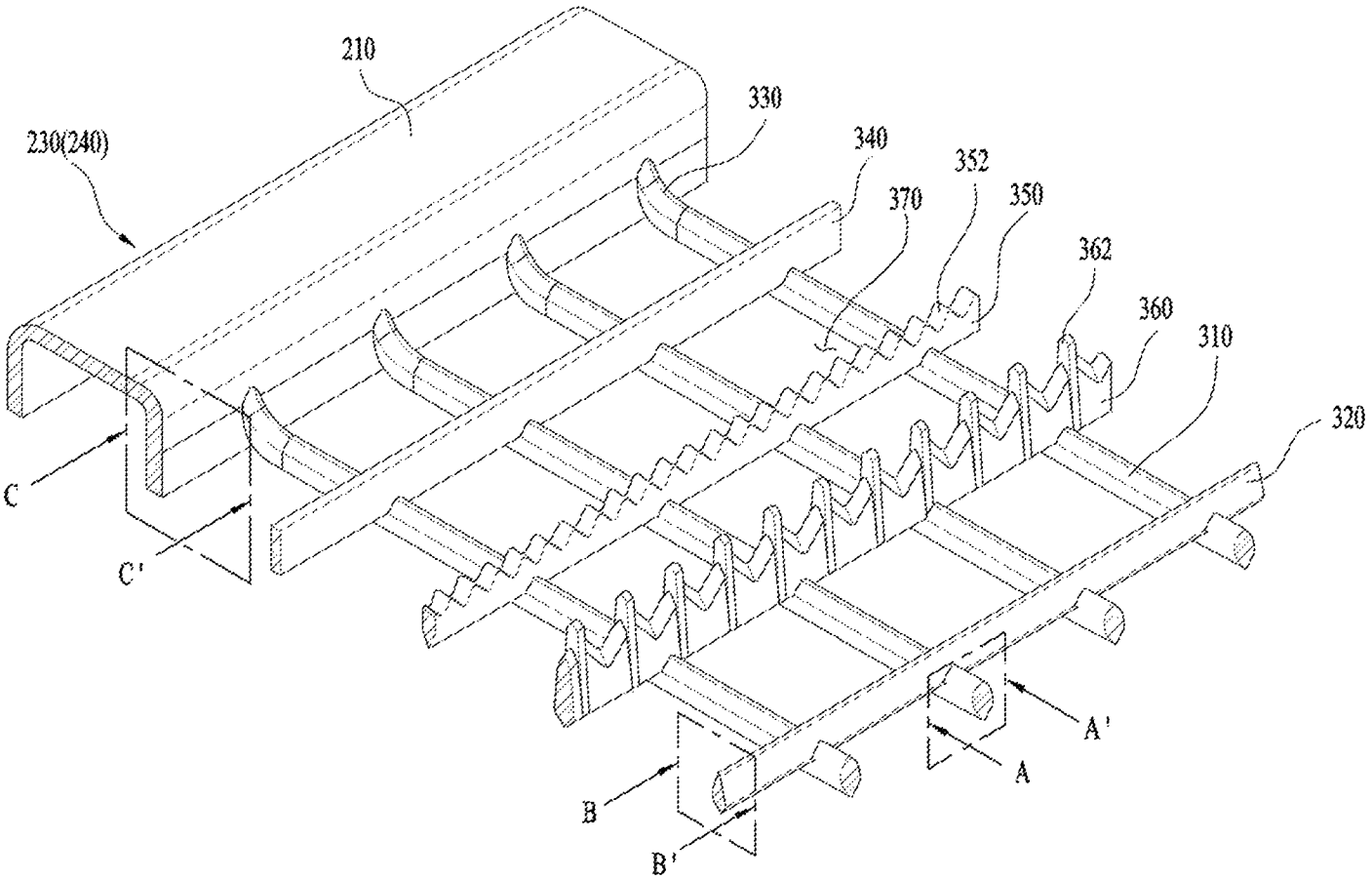
FIG. 5 is a sectional perspective view illustrating an example of a loading surface.
Figure 6:
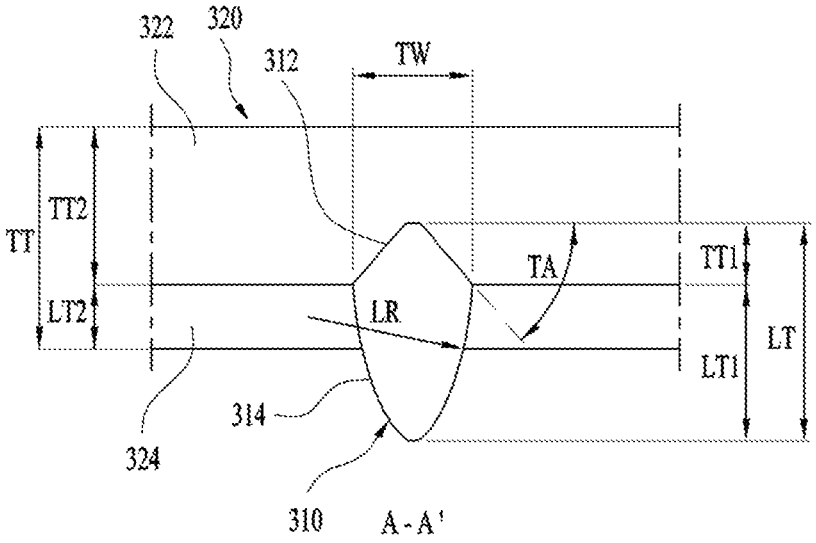
FIG. 6 is a sectional view taken along line A-A' of FIG. 5.
Figure 7:
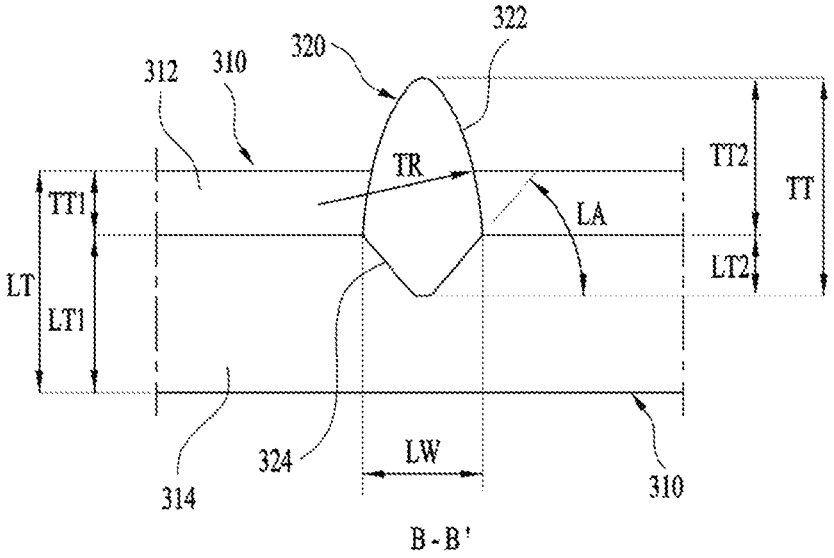
FIG. 7 is a sectional view taken along line B-B' of FIG. 5.
Figure 8:
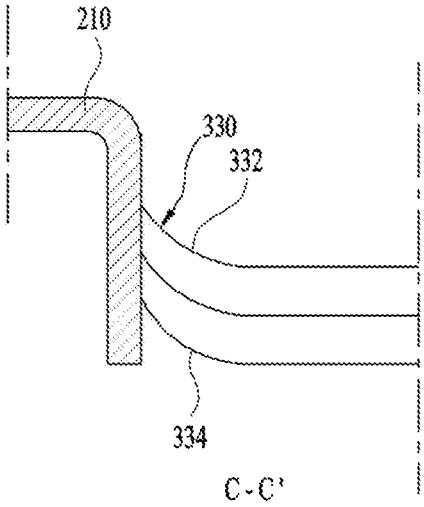
FIG. 8 is a sectional view taken along line C-C' of FIG. 5.

FIG. 5 is a sectional perspective view illustrating a partially cut portion of a loading surface, FIG. 6 is a sectional view taken along line A-A' of FIG. 5, FIG. 7 is a sectional view taken along line B-B' of FIG. 5, and FIG. 8 is a sectional view taken along line C-C' of FIG. 5.

As shown in FIG. 5, the fixed loading surface 300*a* includes a plurality of lower ribs 310 arranged in parallel in one direction of the fixed space loading unit 230, and a plurality of upper ribs 320 arranged in parallel in a direction crossing the lower ribs 310 and positioned at different heights with respect to the lower ribs 310. In some implementations, a plurality of communication holes 370 for draining wash water are formed between the lower ribs 310 and the upper ribs 320, which are arranged to cross each other. For example, the lower ribs 310 may extend along a first direction, and the upper ribs 320 may extend along a second direction orthogonal to the first direction.

In some implementations, the lower ribs 310 and the upper ribs 320 are formed at different heights to cross each other, and such a height difference between the lower ribs 310 and the upper ribs 320 is intended to downsize an area where water drop of residual wash water may be formed in an intersection point between the respective ribs 310 and 320 by cohesion.

That is, the height of the lower ribs 310 and the height of the upper ribs 320 may be formed differently from each other to reduce an area where water drop of wash water may form cohesion at the same height, whereby the water drop of the wash water may easily be dropped from the intersection point of the lower ribs 310 and the upper ribs 320.

In more detail, if the lower ribs 310 and the upper ribs 320 cross each other at the same height, the wash water flowing along the lower portion of each of the ribs 310 and 320 forms a spherical drop at a corner portion where the respective ribs 310 and 320 cross each other and a lower point by surface tension. In some implementations, the spherical drop formed on the lower portion of the intersection point between the respective ribs 310 and 320 has the smallest surface area that may not be good for drying of the wash water.

If the lower ribs 310 and the upper ribs 320 cross each other at different heights, the wash water flowing along the lower portion of the upper ribs 320 flows to the lower portion of the lower ribs 310 by self-load, and the wash water flowing to the lower portion of the lower ribs 310 is formed to be longitudinally spread along an extended length direction of the lower ribs 310.

In this way, if the wash water drop is longitudinally spread along the lower surface of the lower ribs 310, its surface area is more increased than that of the spherical water drop, whereby it may be more favorable for drying of the wash water.

In some examples, at least one of the upper ribs 320 may be provided with a guide rib 340, a support rib 350 or a partition rib 360 selectively formed with a shape different from that of the upper rib to prevent dishes arranged on the fixed loading surface 300*a* from moving when the dishes are washed or the third rack 200 is inserted or withdrawn.

In some implementations, the guide rib 340 may restrict or block the dishes arranged on the fixed loading surface 300*a* from moving, and its height is relatively higher than that of the upper rib 320.

The guide rib 340 may restrict or block movement of the dishes in a crossing direction of the upper ribs 320. In some examples, the guide rib 340 may help to restrict relatively large-sized dishes among the dishes arranged on the fixed loading surface 300*a* from moving.

In some examples, the support rib 350, like the guide rib 340, may restrict or block movement of the dishes arranged on the fixed loading surface 300*a*, and may include an uneven portion 352 that defines a plurality of grooves on an upper surface. The grooved may be arranged along a longitudinal direction of the support rib 350.

The uneven portion 352 of the support rib 350 may prevent the dishes from moving in a direction parallel with a direction where the upper ribs are formed. The uneven portion of the support rib may prevent relatively small-sized dishes among the dishes arranged on the fixed loading surface 300*a* from moving.

In some implementations, the partition rib 360 may be configured to separably load rod shaped eating utensils such as spoons and chopsticks among the dishes arranged on the fixed loading surface 300*a*. The partition rib 360 may include a plurality of partition protrusions 362 spaced apart from one another on an upper surface at a predetermined interval.

As the eating utensils such as spoons and chopsticks are inserted and loaded among the partition protrusions 362, the partition protrusions 362 of the partition rib 360 may load the eating utensils such as spoons and chopsticks without overlap and at the same time prevent the dishes from moving.

The guide rib 340, the support rib 350 and the partition rib 360 may be formed in a single body with the upper rib 320 by modification of an upper shape of the upper rib 320. Alternatively, the guide rib 340, the support rib 350 and the partition rib 360 may be formed additionally to a separate rib arranged in parallel with the upper rib 320 separately from the upper rib 320.

Hereinafter, the lower rib 310 will be described in detail with reference to FIG. 6.

As shown in FIG. 6, the lower rib 310 may be arranged below the upper rib 320 such that its upper portion is partially overlapped with the lower portion of the upper rib 320. In some examples, the lower rib 310 have a bar shape or include a bar having a predetermined width TW and a predetermined height LT.

In some examples, the width TW of the lower rib 310 may be narrower than the height LT. The wash water may easily be drained from the upper portion of the lower rib 310 by a difference between the height LT and the width TW of the lower rib 310.

In some implementations, the height LT of the lower rib 310 may be formed at 3.5 mm to 5.5 mm. In some examples, the height LT of the lower rib 310 may be 4.5 mm. In addition, the width TW of the lower rib 310 may be formed at 1.5 mm to 3.5 mm. In some examples, the width TW of the lower rib 310 may be 2.5 mm.

The lower rib 310 includes an upper inclined portion 312 forming the upper portion and a lower curvature portion 314 forming the lower portion.

In some implementations, the upper inclined portion 312 is formed with a pair of upper inclined portions 312 of which both sides are downwardly inclined based on a center of a length direction of the lower rib 310, and each upper inclined portion 312 is inclined at a predetermined angle TA. For example, the upper inclined portion 312 may define a pair of upper included surfaces that extend downward and are inclined with respect to a center line extending in a vertical direction.

In some implementations, the upper inclined portion 312 is formed with a height TT1 of about 1.2 mm, and its angle TA may be formed between 35° and 55°, for example, at 45° or more.

The greater the angle of the upper inclined portion 312 is, the smaller an adhesive force between the inclined surface of the upper inclined portion 312 and the wash water is. Therefore, the wash water drop may easily flow. However, if the upper inclined portion 312 is formed with an excessively large angle, strength of the lower rib 310 may be weak. In some examples, the upper inclined portion 312 may maintain an angle of 45° with respect to a reference plane (e.g., a bottom surface of the rack).

The lower curvature portion 314 is formed below the upper inclined portion 312, and may be curved based on the lower portion of the lower rib 310 at both sides of the upper inclined portion 312. The lower curvature portion 314 may be formed with a height LT1 of about 3.3 mm, and the lower curvature portion 314 may be formed with a radius LR of about 9.5 mm.

The heights TT1 and LT1 and radius LR of the upper inclined portion 312 and the lower curvature portion 314 may be varied in proportion to the size of the lower rib 310, and their numerical values are not limited to specific values and are illustrated to describe a brief ratio relation.

The upper inclined portion 312 and the lower curvature portion 314 may improve drainage performance of the wash water by allowing the wash water dropped from the upper portions of the upper inclined portion 312 and the lower curvature portion 314 to flow along an inclined surface of the upper inclined portion 312 and a curved surface of the lower curvature portion 314.

Hereinafter, the upper rib 320 will be described in detail with reference to FIG. 7.

As shown in FIG. 7, the upper rib 320 is arranged above the lower rib 310, and is formed such that its lower portion is partially overlapped with the upper portion of the lower rib 310. The upper rib 320 is formed in the form of a bar having a predetermined width LW and a predetermined height TT.

In some examples, the width LW of the upper rib 320 is formed to be narrower than the height TT. The wash water may easily be drained from the upper portion of the upper rib 320 by a difference between the height TT and the width LW of the upper rib 320.

In some cases, the height TT of the upper rib 320 may be formed at 3.5 mm to 5.5 mm. In some examples, the height TT of the upper rib 320 may be 4.5 mm. In addition, the width LW of the upper rib 320 may be in a range from 1.5 mm to 3.5 mm. For example, the width LW of the upper rib 320 may be 2.5 mm.

The upper rib 320 includes an upper curvature portion 322 forming the upper portion and a lower inclined portion 324 forming the lower portion.

The upper curvature portion 322 may be disposed above the lower inclined portion 324, and may be curved based on the upper portion of the lower rib 310 at both sides of the lower inclined portion 324. The upper curvature portion 322 may be formed with the height TT2 of about 3.3 mm, and the lower curvature portion 314 may be formed with a radius TR of about 9.5 mm.

In some implementations, the lower inclined portion 324 is formed with a pair of lower inclined portions 324 of which both sides are upwardly inclined based on a center of a length direction of the lower rib 310, and each lower inclined portion 324 is inclined at a predetermined angle LA. For example, the lower inclined portion 324 may define a pair of lower included surfaces that extend downward and are inclined with respect to a center line extending in a vertical direction.

In some examples, the lower inclined portion 324 is formed with a height LT2 of about 1.2 mm, and its angle LA may be formed between 35° and 55°, for example, at 45° or more.

The greater the angle of the lower inclined portion 324 is, the smaller an adhesive force between the inclined surface of the lower inclined portion 324 and the wash water is. Therefore, the wash water drop may easily flow. However, if the lower inclined portion 324 is formed with an excessively great angle, strength of the upper rib 320 may be weak. In some cases, the lower inclined portion 324 may maintain an angle of 45° with respect to a reference plane (e.g., a bottom surface of the rack).

The heights and radius of the lower inclined portion 324 and the upper curvature portion 322 may be varied in proportion to the size of the upper rib 320, and their numerical values are not limited to specific values and are illustrated to describe a brief ratio relation.

The upper curvature portion 322 and the lower inclined portion 324 may improve drainage performance of the wash water by allowing the wash water dropped from the upper portions of the upper curvature portion 322 and the lower inclined portion 324 to flow along a curved surface of the upper curvature portion 322 and an inclined surface of the lower inclined portion 324.

In some examples, the lower rib 310 and the upper rib 320 may be formed in a single body in such a manner that the upper portion of the lower rib 310 and the lower portion of the upper rib 320 are overlapped with each other. In some implementations, the upper rib 320 and the lower rib 310 may be overlapped with each other such that a tangential line of the upper curvature portion 322 and the lower inclined portion 324 of the upper rib 320 may be matched with a tangential line of the upper inclined portion 312 and the lower curvature portion 314 of the lower rib 310.

In some examples, the lower curvature portion 314 of the lower rib 310 and the upper curvature portion 322 of the upper rib 320 may be formed with convex shaped curved surfaces, but may be formed with plane shaped inclined surfaces in some cases.

In some examples, the upper inclined portion 312 of the lower rib 310 and the lower inclined portion 324 of the upper rib 320 may be formed as plane type inclined surfaces but may be formed as curvature type curved surfaces in some cases.

In some implementations, the lower rib 310 may include the upper inclined portion 312 and the lower curvature portion 314, and the upper rib 320 may include the upper curvature portion 322 and the lower inclined portion. In some implementations, all of the upper portions and the lower portions of the lower rib 310 and the upper rib 320 may be formed as the inclined surfaces or the curved surfaces.

If the lower curvature portion 314 and the upper curvature portion 322 are formed as curved surfaces, a sectional area of each of the ribs 310 and 320 may be increased to improve strength of each of the ribs 310 and 320. In some examples, an angle of the wash water flowing along each of the curvature portions 314 and 322 may be changed to actively flow the wash water.

That is, as the lower curvature portions 314 and the upper curvature portions 322 are extended from the center to the lower portion or the upper portion of each of the ribs 310 and 320, the flowing angle of the wash water of each of the curvature portions 314 and 322 is changed by the curved shape of the lower curvature portion 314 and the upper curvature portion 322. This angle change in each of the curvature portions 314 and 322 may allow flow of wash water more quickly by changing the adhesive force and surface tension between each of the ribs 310 and 320 and the wash water.

FIG. 8 illustrates a connection state between the lower rib 310 (or the upper rib 320) and the outer edge rib 210 (or the middle partition rib 360).

The lower rib 310 and the outer edge rib 210 are connected with each other by the same manner as the connection state between the upper rib 320 and the middle partition rib 360. The connection state between the lower rib 310 and the outer edge rib 210 will be described as an example.

As shown, the rib connector 330 is formed between the lower rib 310 and the outer edge rib 210. The rib connector 330 is intended to prevent the wash water from remaining between the lower rib 310 and the outer edge rib 210 by forming a curvature portion between the lower rib 310 and the outer edge rib 210.

The rib connector 330 may be provided with an upper curvature section 332 and a lower curvature section 334 formed at the lower rib 310 adjacent to the outer edge rib 210. In some implementations, the upper curvature section 332 and the lower curvature section 334 are formed to form the curved surface based on the inner side of the fixed loading surface 300*a* to make sure of the loading space of the fixed loading surface 300*a*.

The upper curvature section 332 may improve drainage performance of the wash water by allowing the wash water remaining in the upper portion of the lower rib 310 to flow to the upper inclined portion 312 of the lower rib 310 along the curved surface.

In some examples, the lower curvature section 334 may improve drainage performance of the wash water by allowing the wash water remaining between the lower rib 310 and the outer edge rib 210 to flow to the lower curvature portion of the lower rib 310.

Hereinafter, the operation of the racks provided in the dishwasher will be described in detail with reference to the accompanying drawings. It should be noted that the elements mentioned below are to be understood with reference to the above description and drawings.

When describing the operation of the third rack, a first use state of the variable space loading unit, which is an initial state, will be described with reference to FIGS. 3 and 4, and a second use state of the variable space loading unit, which is a variable state, will be described with reference to FIGS. 9 and 10.

Figure 9:
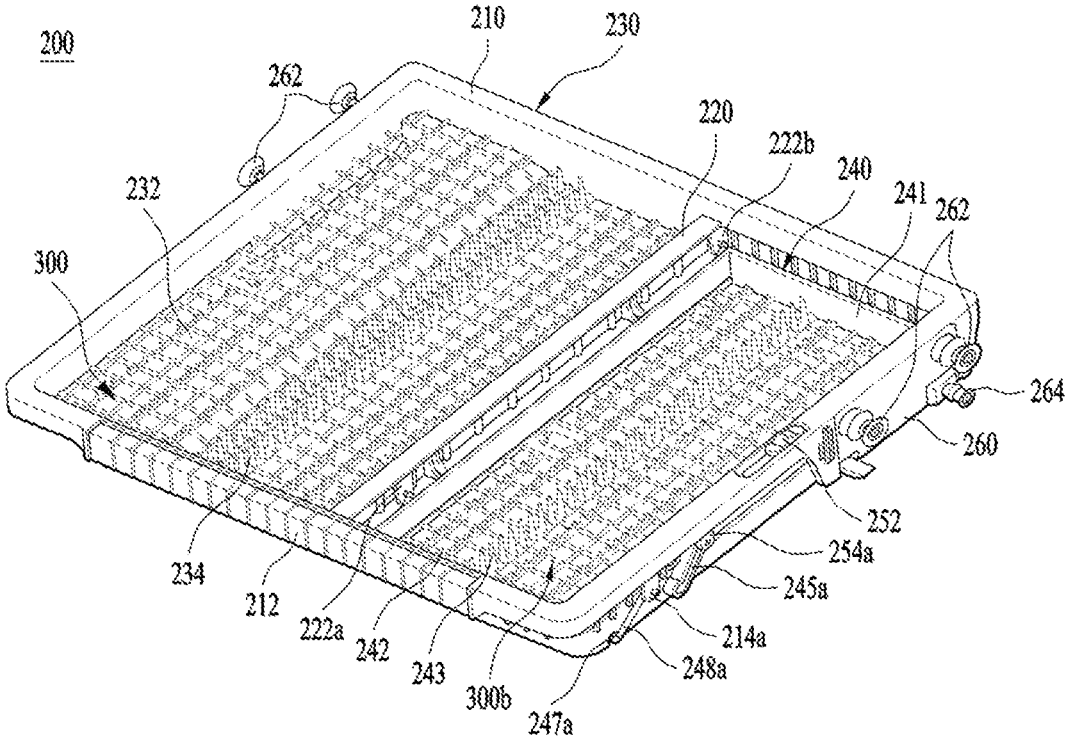
FIG. 9 is a perspective view illustrating an example of a second use state of the rack in the dishwasher.
Figure 10:
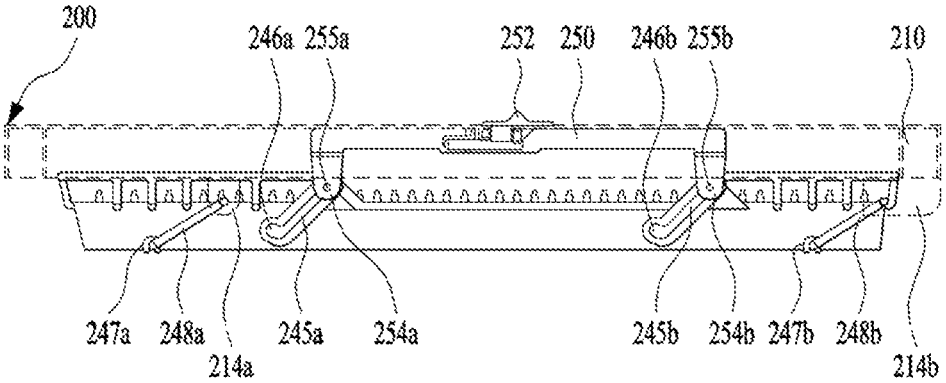
FIG. 10 is a side view illustrating an example of the second use state of the rack in the dishwasher.

FIG. 9 is a perspective view showing a second use state of the third rack of the dishwasher, and FIG. 10 is a side view showing the second use state of the third rack of the dishwasher.

In order for the user to wash dishes using the dishwasher 100, the user opens the door 122 of the dishwasher 100, withdraws at least one of the first, second, and third racks 150, 160, and 200, loads dishes into the withdrawn rack, reintroduces the rack, in which the dishes are placed, into the washing tub 130 of the dishwasher 100, and closes the door 122.

In some examples, when the user operates the dishwasher 100, wash water may be individually or simultaneously supplied to the upper spraying unit 133, the lower spraying unit 134, and the top spraying unit in response to the operation of the drive unit 140, and the dishes loaded in the racks 150, 160, and 200 are washed, rinsed, and dried. The washing, rinsing, and drying of the dishes described above are very similar to the operation of a dishwasher 100, and therefore a detailed description thereof will be omitted.

Before the dishwasher 100 is operated, dishes may be in the respective racks. For example, individual racks of the racks may be withdrawn to place dishes in the specific rack.

The first rack 150 is moved while being guided along the fixed guide rails provided at the lower parts of the inner opposite surfaces of the washing tub 130. When withdrawn, the first rack 150 is located on the location surface of the door 122. Dishes are received in the first rack 150 in the state in which the first rack 150 is located on the location surface of the door 122.

The second rack 160 and the third rack 200 are moved while being guided along the telescopic guide rails provided at the inner opposite surfaces of the washing tub 130. Dishes are loaded into the second rack 160 and the third rack 200 in the state in which the second rack 160 and the third rack 200 are supported by the telescopic guide rails, the lengths of which have been increased.

Relatively small-sized dishes are received in the third rack 200. The dishes may be received in the variable space loading unit 240 provided at one side of the third rack 200 and the fixed space loading unit provided at the other side of the third rack 200.

In the first use state of the variable space loading unit 240, as shown in FIGS. 3 and 4, dishes are loaded into the variable space loading unit 240 in the state in which the variable space loading unit 240 is raised relative to the outer edge rib 210 or the middle partition rib 220.

At this time, the downward movement of the variable space loading unit 240 is restricted by the lifting unit 250. That is, when the lifting unit 250 is moved to the front side of the third rack 200, the front slide protrusion 255*a* provided at the front extension 254*a* of the lifting unit 250 and the rear slide protrusion 255*b* provided at the rear extension 254*b* of the lifting unit 250 are respectively held in the front holding hole 246*a* formed in the front inclined slot 245*a* of the variable space loading unit 240 and the rear holding hole 246*b* formed in the rear inclined slot 245*b* of the variable space loading unit 240. As a result, the position of the variable space loading unit 240 is restricted.

In the case in which the sizes of dishes to be loaded into the fixed space loading unit 230 and the raised variable space loading unit 240 are greater than the sizes of the loading spaces of the fixed space loading unit 230 and the raised variable space loading unit 240, the variable space loading unit 240 may be moved downward to increase the loading space of the variable space loading unit 240.

The loading space of the variable space loading unit 240 is increased as follows. As shown in FIGS. 9 and 10, the user moves the lifting lever 252 of the lifting unit 250 to the rear of the third rack 200. As a result, the front extension 254*a* and the rear extension 254*b* of the lifting unit 250 moves to the rear of the third rack 200 together with the lifting lever 252.

Consequently, the front slide protrusion 255*a* and the rear slide protrusion 255*b*, which are respectively formed at the front extension 254*a* and the rear extension 254*b*, are respectively separated from the front holding hole 246*a* and the rear holding hole 246*b* of the variable space loading unit 240 and then respectively slide along the front inclined slot 245*a* and the rear inclined slot 245*b*.

As a result, the supported state of the variable space loading unit 240 maintained by the front slide protrusion 255*a* and the rear slide protrusion 255*b* of the lifting unit 250 is released, and the front slide protrusion 255*a* and the rear slide protrusion 255*b* move downward along the front inclined slot 245*a* and the rear inclined slot 245*b* by gravity. Consequently, the loading space of the variable space loading unit 240 is increased.

The variable space loading unit 240 moving downward in response to the movement of the lifting unit 250 is suspended by the front support link 248*a* and the rear support link 248*b* while being moved in the manner of a pendulum by the front support link 248*a* and the rear support link 248*b*, which support the lower surface of the variable space loading unit 240. As a result, the loading space of the variable space loading unit 240 is increased.

In some examples, the wash water that has washed the dishes in the third sack 200 is dropped to the fixed loading surface 300*a* of the fixed space loading unit 230 and the variable loading surface 300*h* of the variable space loading unit 240, and is drained to the communication hole 370 formed by each of the ribs 310 and 320 through the lower rib 310 and the upper rib 320, which form the fixed loading surface 300*a* and the variable loading surface 300*b*.

In some implementations, the dishes loaded in each of the loading surfaces 300*a* and 300*b* may be supported in the upper end of the upper curvature portion 322 of the upper rib 320 to minimize the wash water remaining between the dishes and the upper rib 320.

The wash water dropped to the upper rib 320 flows to the lower inclined portion 324 along the curved surface of the upper curvature portion 322 of the upper rib 320. The wash water flowing to the lower inclined portion 324 flows along the inclined surface of the lower inclined portion 324 and then is spread by surface tension in a length direction of the upper rib 320 or dropped to the lower portion of the lower inclined portion 324 by self-load.

The wash water spread by surface tension at the lower portion of the lower inclined portion 324 may form a wider surface area by spreading and then may be dried more easily. The wash water dropped from the lower inclined portion 324 may be drained together with other wash water.

In some examples, the wash water dropped to the lower rib 310 may flow to the lower curvature portion 314 along the inclined surface of the upper inclined portion 312 of the lower rib 310. The wash water flowing to the lower curvature portion 314 flows along the curved surface of the lower curvature portion 314 and then is spread by surface tension in a length direction of the lower rib 310 or dropped to the lower portion of the lower curvature portion 314 by self-load.

The wash water spread by surface tension at the lower portion of the lower curvature portion 314 may form a wider surface area by spreading and then may be dried more easily. The wash water dropped from the lower curvature portion 314 may be drained together with other wash water.

In some examples, the wash water dropped to and remaining in the intersection point between the lower rib 310 and the upper rib 320 may flow from the upper rib 320 to the lower rib 310 in accordance with a crossing shape of each of the ribs 310 and 320 and may be dropped to the lower portion of the rack 200 and then drained, or may be spread from the lower portion of the lower rib 310 and then dried.

That is, the wash water dropped to and remaining in the intersection point between the lower rib 310 and the upper rib 320 may flow to the lower side of the upper rib 320 along the upper curvature portion and the lower inclined portion 324 of the upper rib 320. The wash water flowing to the lower side of the upper rib 320 may flow to the upper inclined portion 312 and the lower curvature portion 314 of the lower rib 310.

In some implementations, in case of the intersection point where the upper rib 320 and the lower rib 310 meet, the upper curvature portion 322/the lower inclined portion 324 and the upper inclined portion 312/the lower curvature portion 314 may cross each other by being spaced apart from each other in an up and down direction, whereby an area of the wash water, which may remain by surface tension, is reduced.

That is, in case of the intersection point between the upper rib 320 and the lower rib 310, since the lower portion of the upper rib 320 and the upper portion of the lower rib 310 are formed to partially cross each other, an area smaller than that when the upper rib 320 and the lower rib 310 cross each other at the same height is formed.

Therefore, the wash water flowing to or remaining in the intersection point between the upper rib 320 and the lower rib 310 may more easily be dropped from the intersection point between the upper rib 320 and the lower rib 310 and then drained due to downsizing of the area on which surface tension of the wash water may act.

As described above, according to the rack of the present disclosure, the loading space of the dishes may efficiently be used in accordance with the shape size of the dishes loaded in the loading space.

In some implementations, it may be possible to improve drying efficiency of the dishes by improving drainage performance of the rack when the dishwasher washes the dishes.

It will be apparent to those skilled in the art that the present disclosure may be embodied in other specific forms without departing from the spirit and essential characteristics of the disclosure. Thus, the above embodiments are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A rack of a dishwasher, the rack comprising:

a loading space configured to accommodate one or more objects to be washed, the loading space comprising a loading surface;

an outer edge rib disposed around the loading surface;

a plurality of lower ribs that extend in a first direction from a side of the outer edge rib; and a plurality of upper ribs that are disposed vertically above the plurality of lower ribs and extend in a second direction crossing the first direction, wherein a lower rib among the plurality of lower ribs comprises:

a lower curvature portion disposed at a lower portion of the lower rib, the lower curvature portion defining lower curved surfaces that are curved toward a center line of the lower rib, and wherein an upper rib among the plurality of upper ribs comprises:

a lower inclined portion disposed at a lower portion of the upper rib, the lower inclined portion defining lower inclined surfaces that extend toward a center line of the upper rib.

2. The rack of the dishwasher of claim 1, wherein the plurality of lower ribs further comprise:

an upper inclined portion disposed at an upper portion of the lower rib, the upper inclined portion defining upper inclined surfaces that extend downward and are inclined with respect to the center line of the lower rib.

3. The rack of the dishwasher of claim 2, wherein a height of the lower curvature portion with respect to a lower end of the lower curvature portion is greater than a height of the upper inclined portion with respect to an upper end of the lower curvature portion.

4. The rack of the dishwasher of claim 2, wherein the plurality of upper ribs further comprise:

an upper curvature portion arranged across the upper inclined portion of the lower rib, the upper curvature portion defining upper curved surfaces that extend toward the loading surface.

5. The rack of the dishwasher of claim 4, wherein the lower inclined portion crosses at least a portion of the upper portion of the lower rib.

6. The rack of the dishwasher of claim 5, wherein a height of the upper curvature portion with respect to an upper end of the lower inclined portion is greater than a height of the lower inclined portion with respect to a lower end of the lower inclined portion.

7. The rack of the dishwasher of claim 5, wherein the upper rib crosses the lower rib, wherein the upper rib defines a first boundary line between the upper curvature portion and the lower inclined portion of the upper rib, wherein the lower rib defines a second boundary line between the upper inclined portion and the lower curvature portion of the lower rib, and wherein the first boundary line and the second boundary line are disposed at a same height with respect to a lower end of the lower curvature portion.

8. The rack of the dishwasher of claim 1, further comprising:

a rib connector that has a curved shape and connects the outer edge rib to a lower rib among the plurality of lower ribs or to an upper rib among the plurality of upper ribs, wherein the rib connector is positioned vertically between the lower rib and the upper rib with respect to the loading surface.

9. The rack of the dishwasher of claim 8, wherein the rib connector comprises an upper curvature section that has a curved shape and is disposed at the upper rib or the lower rib.

10. The rack of the dishwasher of claim 9, wherein the rib connector further comprises a lower curvature section that has a curved shape and is disposed vertically below the upper rib or the lower rib.

11. The rack of the dishwasher of claim 1, further comprising a guide rib that is disposed vertically above the plurality of lower ribs and extends across the plurality of lower ribs in the second direction, the guide rib being positioned vertically above the at least one of the plurality of upper ribs.

12. The rack of the dishwasher of claim 1, further comprising a support rib that is disposed vertically above the plurality of lower ribs and extends across the plurality of lower ribs in the second direction, the support rib defining a plurality of grooves arranged along the second direction.

13. The rack of the dishwasher of claim 1, further comprising a partition rib that is disposed vertically above the plurality of lower ribs and extends across the plurality of lower ribs in the second direction, the partition rib comprising a plurality of partition protrusions arranged along the second direction and spaced apart from one another by a predetermined interval.

14. A rack of a dishwasher, the rack comprising:

a loading space configured to accommodate one or more objects to be washed, the loading space comprising a loading surface;

an outer edge rib disposed around the loading surface;

a plurality of lower ribs that extend in a first direction from a side of the outer edge rib; and a plurality of upper ribs that are disposed vertically above the plurality of lower ribs and extend in a second direction crossing the first direction, wherein a lower rib among the plurality of lower ribs comprises:

a first upper inclined portion disposed at an upper portion of the lower rib, the first upper inclined portion defining first upper inclined surfaces that extend downward and are inclined with respect to a center line of the lower rib, and a first lower inclined portion arranged vertically below the first upper inclined portion, the first lower inclined portion defining first lower inclined surfaces that extend toward the center line of the lower rib, and wherein an upper rib among the plurality of upper ribs comprises:

a second upper inclined portion disposed at an upper portion of the upper rib, the second upper inclined portion defining second upper inclined surfaces that extend downward and are inclined with respect to a center line of the upper rib, and a second lower inclined portion arranged vertically below the second upper inclined portion, the second lower inclined portion defining second lower inclined surfaces that extend toward the center line of the upper rib.

15. A rack of a dishwasher of claim 1, the rack comprising:

a loading space configured to accommodate one or more objects to be washed, the loading space comprising a loading surface;

an outer edge rib disposed around the loading surface;

a plurality of lower ribs that extend in a first direction from a side of the outer edge rib; and a plurality of upper ribs that are disposed vertically above the plurality of lower ribs and extend in a second direction crossing the first direction, wherein a lower rib among the plurality of lower ribs comprises:

a first upper curvature portion disposed at an upper portion of the lower rib, the first upper curvature portion defining first upper curved surfaces that are curved and extend toward the loading surface, and a first lower curvature portion arranged vertically below the first upper curvature portion, the first lower curvature portion defining first lower curved surfaces that are curved and extend toward a center line of the lower rib, and wherein an upper rib among the plurality of upper ribs comprises:

a second upper curvature portion disposed at an upper portion of the upper rib, the second upper curvature portion defining second upper curved surfaces that are curved and extend toward the loading surface; and a second lower curvature portion arranged vertically below the second upper curvature portion, the second lower curvature portion defining second lower curved surfaces that are curved and extend toward a center line of the upper rib.

16. A dishwasher comprising:

a washing tub that defines a washing space;

a rack configured to accommodate one or more objects to be washed, the rack being configured to be inserted into and withdrawn out of the washing tub; and a plurality of sprayer configured to spray wash water to the rack, wherein the rack comprises:

a loading space configured to accommodate the one or more objects, the loading space comprising a loading surface, an outer edge rib disposed around the loading surface, a plurality of lower ribs that extend in a first direction from a side of the outer edge rib, and a plurality of upper ribs that are disposed vertically above the plurality of lower ribs and extend in a second direction crossing the first direction, wherein a lower rib among the plurality of lower ribs comprises:

a lower curvature portion disposed at a lower portion of the lower rib, the lower curvature portion defining lower curved surfaces that are curved toward a center line of the lower rib, and wherein an upper rib among the plurality of upper ribs comprises:

a lower inclined portion that is disposed at a lower portion of the upper rib, the lower inclined portion defining lower inclined surfaces that extend toward a center line of the upper rib.

17. The dishwasher of claim 16, wherein the plurality of lower ribs further comprise:

an upper inclined portion disposed at an upper portion of the lower rib, the upper inclined portion defining upper inclined surfaces that extend downward and are inclined with respect to the center line of the lower rib.

18. The dishwasher of claim 17, wherein the plurality of upper ribs further comprise:

an upper curvature portion arranged across the upper inclined portion of the lower rib, the upper curvature portion defining upper curved surfaces that extend toward the loading surface.

19. The dishwasher of claim 18, wherein the upper rib crosses the lower rib, wherein the upper rib defines a first boundary line between the upper curvature portion and the lower inclined portion of the upper rib, wherein the lower rib defines a second boundary line between the upper inclined portion and the lower curvature portion of the lower rib, and wherein the first boundary line and the second boundary line are disposed at a same height with respect to a lower end of the lower curvature portion.

* * * * *